US010958004B1

(12) United States Patent
Peterson et al.

(10) Patent No.: US 10,958,004 B1
(45) Date of Patent: Mar. 23, 2021

(54) LOCATION ORIENTATION OF WIRING RELATIVE TO ELECTRICAL CONNECTOR

(71) Applicant: Aptiv Technologies Limited, St. Michael (BB)

(72) Inventors: David R. Peterson, Aurora, OH (US); Joseph Sudik, Jr., Niles, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/670,147

(22) Filed: Oct. 31, 2019

(51) Int. Cl.

| | |
|---|---|
| ***H01R 12/77*** | (2011.01) |
| ***H01R 12/59*** | (2011.01) |
| *H01B 13/012* | (2006.01) |
| *H01B 7/00* | (2006.01) |

(52) U.S. Cl.
CPC ..... *H01R 12/771* (2013.01); *H01R 12/592* (2013.01); *H01B 7/0045* (2013.01); *H01B 13/01254* (2013.01)

(58) Field of Classification Search
None
See application file for complete search history.

(56) References Cited

U.S. PATENT DOCUMENTS

| | | | | |
|---|---|---|---|---|
| 3,999,826 | A * | 12/1976 | Yurtin | H01R 12/592 439/495 |
| 4,293,177 | A * | 10/1981 | Weisenburger | H01R 12/68 439/400 |
| 4,406,511 | A * | 9/1983 | Hayes | H01R 12/79 439/449 |
| 7,063,561 | B2 | 6/2006 | Pabst | |
| 7,144,256 | B2 | 12/2006 | Pabst et al. | |
| 7,232,334 | B2 | 6/2007 | Shimizu et al. | |
| 7,887,351 | B2 * | 2/2011 | Wang | H01R 12/88 439/260 |
| 9,048,563 | B2 | 6/2015 | Miura et al. | |
| 9,300,066 | B2 * | 3/2016 | Venaleck | H01R 12/771 |

FOREIGN PATENT DOCUMENTS

| | | | |
|---|---|---|---|
| EP | 669627 | B1 | 8/2002 |

* cited by examiner

*Primary Examiner* — Ross N Gushi
(74) *Attorney, Agent, or Firm* — RMCK Law Group, PLC

(57) ABSTRACT

An electrical connector includes wiring with multiple wires. Each wire has a conductor covered in insulation. The insulation includes webbing that interconnects the wires to one another. The insulation has an aperture that provides a first locating feature. The wires have a stripped portion that exposes the conductors. A housing receives the stripped portion. The housing includes a projection that provides a second locating feature that cooperates the first locating feature to orient and locate the stripped portion within the housing.

15 Claims, 3 Drawing Sheets

LOCATION ORIENTATION OF WIRING RELATIVE TO ELECTRICAL CONNECTOR

FIELD OF INVENTION

This disclosure relates to an electrical connector for use in a wiring harness that uses flat wires, for example.

SUMMARY

In one exemplary embodiment, an electrical connector includes wiring with multiple wires. Each wire has a conductor covered in insulation. The insulation includes webbing that interconnects the wires to one another. The insulation has an aperture that provides a first locating feature. The wires have a stripped portion that exposes the conductors. A housing receives the stripped portion. The housing includes a projection that provides a second locating feature that cooperates the first locating feature to orient and locate the stripped portion within the housing.

In a further embodiment of the above, each conductor is formed of a solid, non-stranded conductive material. Each of the conductors has a generally rectangular profile that have a width and a height. The width is at least twice the height.

In a further embodiment of any of the above, the webbing has a longitudinally extended opening that separates adjacent wires.

In a further embodiment of the above, the insulation is provided on either side of one of the stripped portions.

In a further embodiment of any of the above, the housing includes first and second housing portions that are secured to one another about the stripped portion. The first housing portion is configured to securely locate the wiring with respect to the housing. The second housing portion includes an electrical contact that engages one of the stripped portion.

In a further embodiment of any of the above, the first housing portion includes a supplemental locating feature that includes a first set of barbs spaced apart from a second set of barbs. The first and second sets of barbs retain the stripped portion. The insulation includes edges adjacent to the first and second sets of barbs to longitudinally locate the wiring relative to the housing.

In a further embodiment of any of the above, the aperture includes a first aperture between the wires. The second locating feature is provided by a protrusion on the first housing portion that is covered by the second housing portion in an assembled connector condition.

In a further embodiment of any of the above, the aperture includes a second aperture between the wires. The second locating feature is provided by a protrusion on the first housing portion that is outside of the second housing portion in an assembled connector condition.

In a further embodiment of any of the above, the aperture is a notch between the wires. The second locating feature is a rib on the first housing portion that is arranged at an edge of the insulation at the stripped portion.

In a further embodiment of any of the above, the aperture is arranged at an outer edge of the insulation. The second locating is a locator on the first housing portion.

In another exemplary embodiment, an electrical connector includes wiring with multiple wires. Each wire has a conductor covered in insulation. The insulation includes webbing that interconnects the wires to one another. The insulation has an aperture that provides a first locating feature. The wires have a stripped portion that exposes the conductors. A housing receives the stripped portion. The housing includes a locating feature that includes a first set of barbs spaced apart from a second set of barbs. The first and second sets of barbs retain the stripped portions. The insulation includes edges adjacent to the first and second sets of barbs to longitudinally locate the wiring relative to the housing.

In a further embodiment of any of the above, the housing includes first and second housing portions secured to one another about the stripped portions. The first housing portion is configured to securely locate the wiring with respect to the housing. The second housing portion includes an electrical contact that engages one of the stripped portions. Each conductor is formed of a solid, non-stranded conductive material. Each of the conductors have a generally rectangular profile that have a width and a height. The width is at least twice the height.

In a further embodiment of any of the above, the aperture includes a first aperture between the wires. The second locating feature is provided by a protrusion on the first housing portion that is covered by the second housing portion in an assembled connector condition.

In a further embodiment of any of the above, the aperture includes a second aperture between the wires. The second locating feature is provided by a protrusion on the first housing portion that is outside of the second housing portion in an assembled connector condition.

In a further embodiment of any of the above, the aperture is a notch between the wires. The second locating feature is a rib on the first housing portion that is arranged at an edge of the insulation at the stripped portion.

In a further embodiment of any of the above, the aperture is arranged at an outer edge of the insulation. The second locating feature is a locator on the first housing portion.

In another exemplary embodiment, a method of assembling an electrical connector includes providing wiring with multiple wires. Each wire has a conductor covered in insulation. The insulation includes webbing that interconnects the wires to one another. The insulation has an aperture that provides a first locating feature. The wires have a stripped portion that exposes the conductors. Each of the conductors have a generally rectangular profile that have a width and a height. The width is at least twice the height. The stripped portion is mounted into a housing with a second locating feature. The second locating feature is positioned into the aperture of the first locating feature.

In a further embodiment of any of the above, the housing is provided by a first housing portion. The method further includes a second housing portion secured to the first housing portion and about the stripped portion. The second housing portion includes an electrical contact that engages the stripped portion during the securing step.

In a further embodiment of any of the above, the mounting step includes the stripped portion retained with first and second sets of barbs spaced apart from one another. The first and second sets of barbs retain the stripped portion. The insulation includes edges adjacent to the first and second sets of barbs to longitudinally locate the wiring relative to the housing.

In a further embodiment of any of the above, the providing step includes the aperture being formed in the insulation prior to the mounting and positioning steps.

BRIEF DESCRIPTION OF THE DRAWINGS

The disclosure can be further understood by reference to the following detailed description when considered in connection with the accompanying drawings wherein.

DETAILED DESCRIPTION

Figure 1:
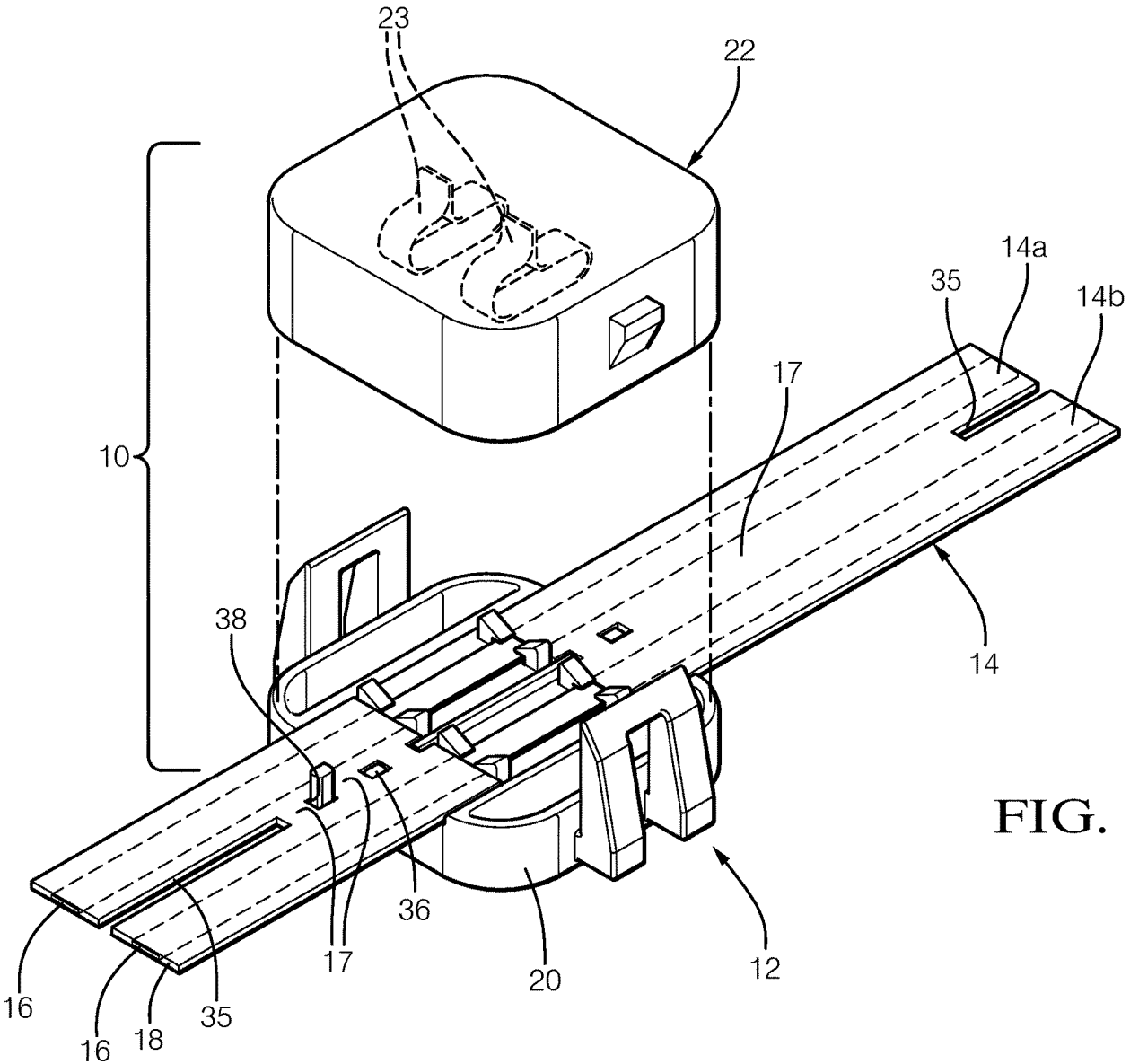
FIG. 1 is a perspective view of an example electrical connector for use with flat wires.

An example electrical connector 10 is illustrated in FIG. 1. The connector 10 is particularly suitable for use with flat wires. The connector 10 includes an insulative housing 12, which may be constructed from multiple plastic pieces, such as first and second housing portions 20, 22. The exemplary housing 12 may vary from the configuration depicted, particularly the second housing portion 22, which may be integrated with an electrical component such as a lighting device, sensor, electrical connector, or other electrical device. In the example, the second housing portion 22 includes electrical contacts provided by springs that supply electrical continuity between wiring 14 and the electrical component.

Figure 3:
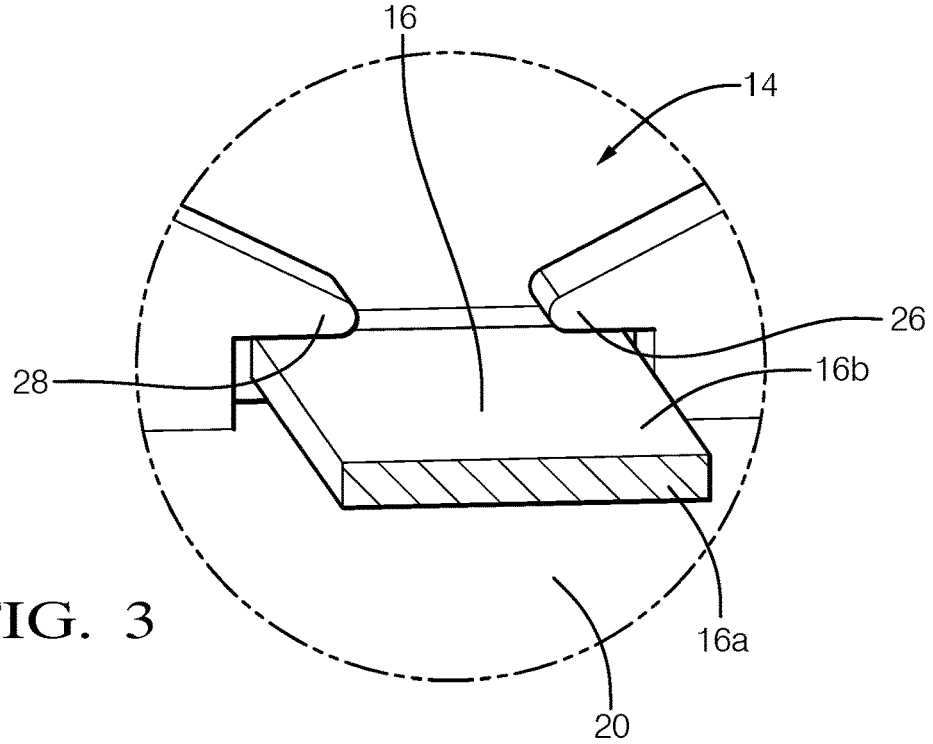
FIG. 3 is an enlarged perspective view of a wire oriented with locating features that include a set of barbs.

The connector 10 is used in conjunction with wiring 14, which may include one or more wires 14*a*, 14*b*. Each wire includes a relatively flat conductor 16 that is generally rectangular and is encased in a non-conductive, flexible plastic insulation 18 to provide a cross-sectional aspect ratio of at least 2:1 with respect to the width and the height. As used herein, "generally rectangular" includes any shape having a width greater than its height in cross section and may include rectangular, parallelogram, trapezoid, oval, obround, and elliptical shapes. In some embodiments, the aspect ratio may be at least 3:1. In other embodiments, the aspect ratio may be at least 5:1. The conductor 16 is provided by non-stranded electrically conductive material, such as a flat copper wire 16*a* plated with tin 16*b* (FIG. 3). The adjacent wires 14*a*, 14*b* may be interconnected with insulation material that forms webbing 17, which provides structurally integrity to the wiring 14 during handling.

Figure 2:
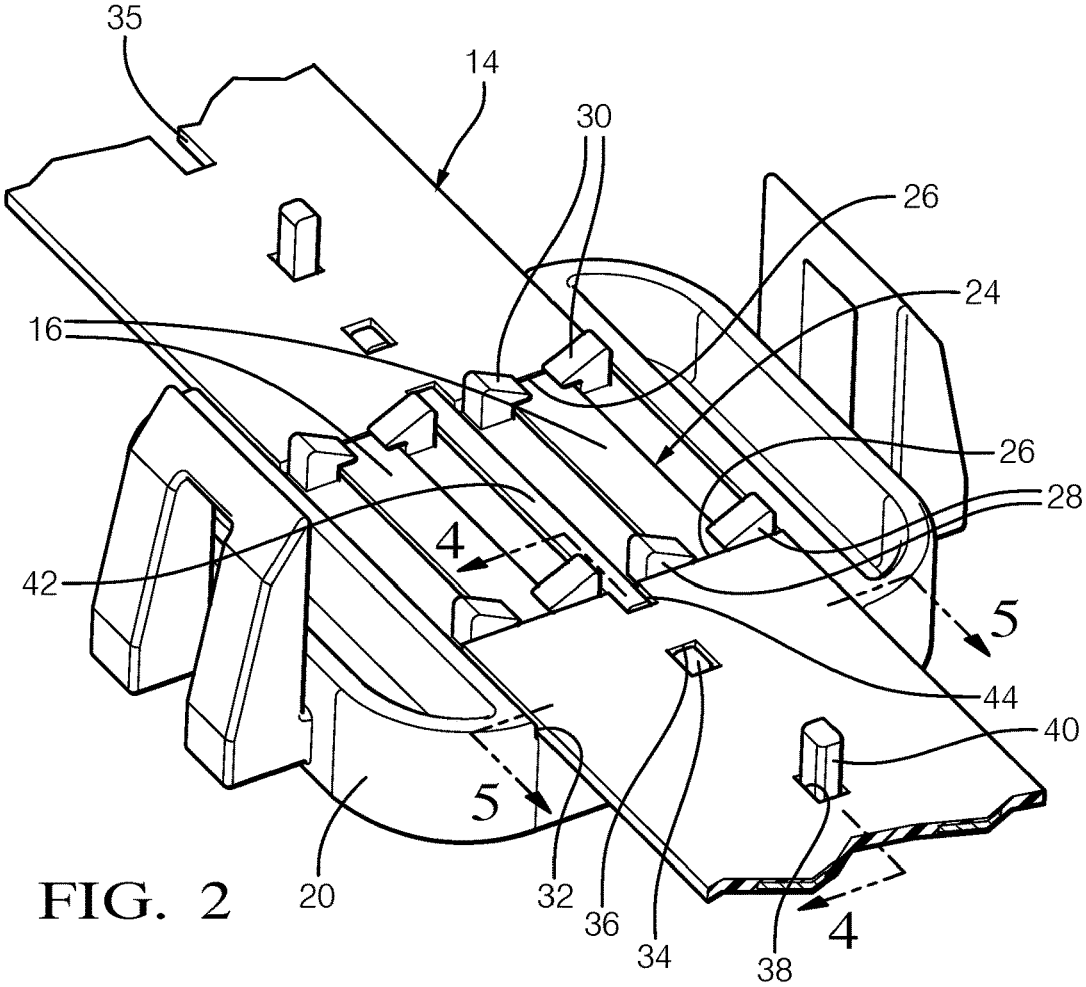
FIG. 2 is a perspective view of a first housing portion supporting multiple wires.

It is desirable to positively locate the wiring 14 with respect to the housing 12 and to provide strain relief to the wires 14*a*, 14*b*. To this end, various locating features may be used between the housing 12 and wiring 14 to orient and securely hold the wiring 14 during assembly and use. Referring to FIGS. 1-3, the wires 14*a*, 14*b* have a stripped portion 24 that expose the conductors 16 at a longitudinal location defined by edges 26 of the insulation 18. That is, the stripped portions 24 are bounded by insulation 18 at either end. In the example, the first housing portion 20 includes a first set of barbs 28 spaced apart from a second set of barbs 30. The conductors 16 are clipped in beneath and retained by their respective sets of barbs. The first and second sets of barbs 28, 30 retain the stripped portions 24 longitudinally as well, such that the edges 26 are longitudinally located by the barbs to orient the wiring 14 in the desired position relative to the housing 12. In this illustrated embodiment, the barbs 28, 30 overlay the stripped portions 24. In this manner, the edges 26 and barbs 28, 30 cooperate to provide locating features that interact with one another to secure the wiring 14 relative to housing 12.

The above locating features sufficiently locate the wiring 14 during assembly of the housing 12, but may not provide sufficient strain relief alone. Additional or different locating features may also be used with the barbs. For example, the insulation 18 may include one or more apertures that cooperates with a corresponding projection provided by a second locating feature of the housing 12. The apertures may be provided by small holes, while larger elongated openings 35 (FIG. 1) may be provided in the insulation 18 to provide a type of dash-dot interruption in the webbing 17. More webbing 17 is provided near the housing 12 to provide improved structural integrity to the wiring 14, while larger elongated openings 35 in the webbing 17 may be provided elsewhere to increase flexibility for ease of handling and routing within a vehicle, for example.

Figure 4:
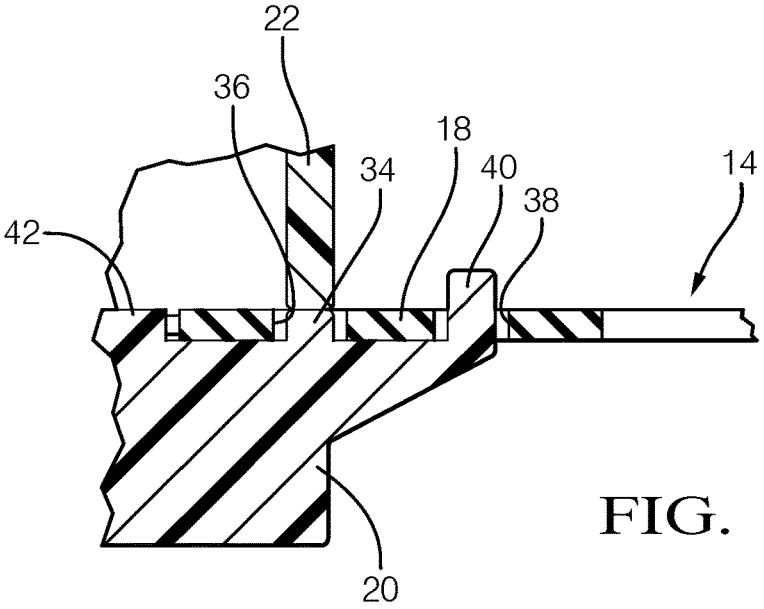
FIG. 4 is a cross-sectional view taken along line 4-4 of FIG. 2.
Figure 5:
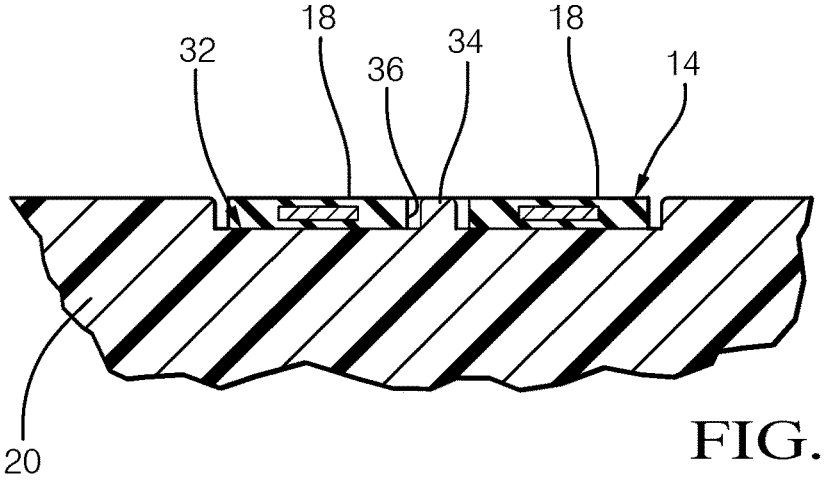
FIG. 5 is a cross-sectional view taken along line 5-5 in FIG. 2.

In one example, the wiring aperture is provided by a first aperture 36 between the wires 14*a*, 14*b*, which provides a break or interruption in the webbing 17, as shown in FIGS. 4 and 5. A recess 32 is provided in the first housing portion 20 to laterally locate the wiring 14. The second locating feature is provided by a pin 34 on the first housing portion 20 that is covered by the second housing portion 22 in an assembled condition, shown in FIG. 4. In this manner, the wiring 14 is captured by the first and second housing portions 20, 22 using the insulation 18, but without putting strain on the conductors 16.

In another embodiment, the aperture is provided a second aperture 38 between the wires 14*a*, 14*b*. The second locating feature is provided by a protrusion 40 on the first housing portion 20 that is outside the second housing portion 22 in an assembled connector condition, as shown in FIG. 4. The protrusion 40 is longer than the pin 34, which enables the wiring 14 to be easily oriented with the first housing portion 20 early in the assembly process before the conductors 16 are inserted beneath the barbs 28, 30, for example.

Locating features also may be provided by an aperture forming a notch 44 between wires 14*a*, 14*b*. The second locating feature is provided by a rib 42 on the first housing portion 20 that is arranged at the edge 26 of the insulation 18 at the stripped portion 24, best shown in FIGS. 2 and 4.

Figure 6:
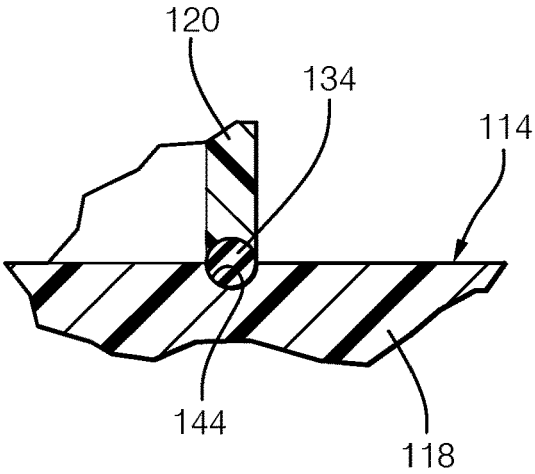
FIG. 6 is an enlarged elevational view of an outer edge of a wire cooperating with a locating feature of the housing.

In another example embodiment, the aperture may be provided by a notch 144 at an outer edge of the insulation 118 of wiring 114, as shown in FIG. 6. A locating pin 134 is provided on the first housing portion 120 to cooperate with the notch 144.

The various apertures and opening in the wiring 14 may be formed using various techniques. These holes may be laser cut, punched, formed during molding of the insulation 18, or by any other suitable technique prior to the installing the wiring into the housing 12.

In operation, a method of assembling an electrical connector 10 includes a step of providing wiring 14 with multiple wires 14*a*, 14*b*. Each wire has a conductor 16 covered in insulation 18. Insulation 18 includes webbing 17 that interconnects the wire 14*a*, 14*b* to one another. The insulation 18 has an aperture (e.g., 36, 38, 44, 144) that provides a first locating feature. The wires have a stripped portion 24 exposing the conductors 16. Each of the wires 14*a*, 14*b* has a profile with a height in which the width is at least twice the height. The stripped portion 24 is mounted to the housing 12 with the second locating feature (e.g., 34, 40, 42, 134), and the second locating feature is positioned into the aperture of the first locating feature.

The first and second barbs 28, 30 provide a supplemental locating feature by retaining the stripped portions 24 of conductors 16 and by longitudinally abutting edges 26.

The second housing portion 22 is secured to the first housing portion 20 using one or more snaps. The second housing portion may carry an electrical contact 23 that may be provided by one or more springs. The electrical contacts 23 engage the stripped portions 24 when the housing is in the assembled housing condition.

Additional examples are described below.

Example 1

An electrical connector (10) comprising wiring (14) with multiple wires (14*a*, 14*b*), each wire having a conductor (16) covered in insulation (18), the insulation (18) includes webbing (17) that interconnects the wires (14*a*, 14*b*) to one another, the insulation (18) having an aperture providing a first locating feature, the wires having a stripped portion (24) exposing the conductors (16) and a housing (12) receiving the stripped portion (24), the housing (12) including a projection providing a second locating feature that cooperates the first locating feature to orient and locate the stripped portion (24) within the housing (12).

Example 2

The electrical connector (10) of example 1, wherein each conductor (16) is formed of a solid, non-stranded conductive material and wherein each of the conductors (16) has a generally rectangular profile having a width and a height, wherein the width is at least twice the height.

Example 3

The electrical connector (10) of example 1 or 2, wherein the webbing (17) has a longitudinally extending opening (35) that separates adjacent wires (14*a*).

Example 4

The electrical connector (10) of any one of the preceding examples, wherein the insulation (18) is provided on either side of one of the stripped portions (24).

Example 5

The electrical connector (10) of any one of the preceding examples, wherein the housing (12) includes first and second housing portions (20, 22) secured to one another about the stripped portion (24), the first housing portion (20) is configured to securely locate the wiring (14) with respect to the housing (12), and the second housing portion (22) includes an electrical contact (23) engaging one of the stripped portions (24).

Example 6

The electrical connector (10) of example 5, wherein the first housing portion (20) includes a supplemental locating feature comprising a first set of barbs (28) spaced apart from a second set of barbs (30), the first and second sets of barbs (28, 30) retaining the stripped portion (24), and the insulation (18) including edges (26) adjacent to the first and second sets of barbs (28, 30) to longitudinally locate the wiring (14) relative to the housing (12).

Example 7

The electrical connector (10) of example 5 or 6, wherein the aperture includes a first aperture (36) between the wires (14*a*, 14*b*), and the second locating feature is provided by a pin (34) on the first housing portion (20) that is covered by the second housing portion (22) in an assembled connector condition.

Example 8

The electrical connector (10) of any one of the examples 5 to 7, wherein the aperture includes a second aperture (38) between the wires (14*a*, 14*b*), and the second locating feature is provided by a protrusion (40) on the first housing portion (20) that is outside of the second housing portion (22) in an assembled connector condition.

Example 9

The electrical connector (10) of any one of the examples 5 to 8, wherein the aperture is a notch (44) between the wires (14*a*, 14*b*), and the second locating feature is a rib (42) on the first housing portion (20) arranged at an edge of the insulation (18) at the stripped portion (24).

Example 10

The electrical connector (10) of any one of the examples 5 to 9, wherein the aperture is notch (144) arranged at an outer edge of the insulation (18), and the second locating is a locating pin (134) on the first housing portion (20).

Example 11

An electrical connector (10) comprising wiring (14) with multiple wires (14*a*, 14*b*), each wire having a conductor (16) covered in insulation (18), the insulation (18) includes webbing (17) that interconnects the wires (14*a*, 14*b*) to one another, the insulation (18) having an aperture providing a first locating feature, the wires (14*a*, 14*b*) having a stripped portion (24) exposing the conductors (16) and a housing (12) receiving the stripped portion (24), the housing (12) including a locating feature comprising a first set of barbs (28) spaced apart from a second set of barbs (30), the first and second sets of barbs (28, 30) retaining the stripped portions (24), and the insulation (18) including edges (26) adjacent to the first and second sets of barbs (28, 30) to longitudinally locate the wiring (14) relative to the housing (12).

Example 12

The electrical connector (10) of example 11, wherein the housing (12) includes first and second housing portions (20, 22) secured to one another about the stripped portions (24), the first housing portion (20) is configured to securely locate the wiring (14) with respect to the housing (12), and the second housing portion (22) includes an electrical contact (23) engaging one of the stripped portions (24), wherein each conductor (16) is formed of a solid, non-stranded conductive material, wherein each of the conductors (16) has a generally rectangular profile having a width and a height, and wherein the width is at least twice the height.

Example 13

The electrical connector (10) of example 11 or 12, wherein the aperture includes a first aperture (36) between the wires (14*a*, 14*b*), and the second locating feature is provided by a pin (34) on the first housing portion (20) that is covered by the second housing portion (22) in an assembled connector condition, and/or optionally, wherein the aperture includes a second aperture (38) between the wires (14*a*, 14*b*), and the second locating features is provided by a protrusion (40) on the first housing portion (20) that is outside of the second housing portion (22) in an assembled connector condition.

Example 14

The electrical connector (10) of any one of the examples 11 to 13, wherein the aperture is a notch (44) between the wires (14*a*, 14*b*), and the second locating feature is a rib (42) on the first housing portion (20) arranged at an edge of the insulation (18) at the stripped portion (24).

Example 15

The electrical connector (10) of any one of the examples 11 to 13, wherein the aperture is a notch (144) arranged at an outer edge of the insulation (18), and the second locating feature is a locating pin (134) on the first housing portion (20).

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An electrical connector comprising:

wiring with multiple wires, each wire having a conductor covered in insulation, the insulation includes webbing that interconnects the wires to one another, the insulation having an aperture providing a first locating feature, the wires having a stripped portion exposing the conductors; and a housing receiving the stripped portion, the housing including a projection providing a second locating feature that cooperates the first locating feature to orient and locate the stripped portion within the housing, wherein the housing includes first and second housing portions secured to one another about the stripped portion, the first housing portion is configured to securely locate the wiring with respect to the housing, and the second housing portion includes an electrical contact engaging one of the stripped portions, and wherein the first housing portion includes a supplemental locating feature comprising a first set of barbs spaced apart from a second set of barbs, the first and second sets of barbs retaining the stripped portion, and the insulation including edges adjacent to the first and second sets of barbs to longitudinally locate the wiring relative to the housing.

2. The electrical connector of claim 1, wherein each conductor is formed of a solid, non-stranded conductive material and wherein each of the conductors has a generally rectangular profile having a width and a height, wherein the width is at least twice the height.

3. The electrical connector of claim 2, wherein the webbing has a longitudinally extending opening that separates adjacent wires.

4. The electrical connector of claim 2, wherein the insulation is provided on either side of one of the stripped portions.

5. The electrical connector of claim 1, wherein the aperture includes a first aperture between the wires, and the second locating feature is provided by a pin on the first housing portion that is covered by the second housing portion in an assembled connector condition.

6. The electrical connector of claim 5, wherein the aperture includes a second aperture between the wires, and the second locating feature is provided by a protrusion on the first housing portion that is outside of the second housing portion in an assembled connector condition.

7. The electrical connector of claim 1, wherein the aperture is a notch between the wires, and the second locating feature is a rib on the first housing portion arranged at an edge of the insulation at the stripped portion.

8. The electrical connector of claim 1, wherein the aperture is a notch arranged at an outer edge of the insulation, and the second locating is a locating pin on the first housing portion.

9. An electrical connector comprising:

wiring with multiple wires, each wire having a conductor covered in insulation, the insulation includes webbing that interconnects the wires to one another, the insulation having an aperture providing a first locating feature, the wires having a stripped portion exposing the conductors; and a housing receiving the stripped portion, the housing including a locating feature comprising a first set of barbs spaced apart from a second set of barbs, the first and second sets of barbs retaining the stripped portions, and the insulation including edges adjacent to the first and second sets of barbs to longitudinally locate the wiring relative to the housing, wherein the housing includes first and second housing portions secured to one another about the stripped portions, the first housing portion is configured to securely locate the wiring with respect to the housing, and the second housing portion includes an electrical contact engaging one of the stripped portions, wherein each conductor is formed of a solid, non-stranded conductive material, wherein each of the conductors has a generally rectangular profile having a width and a height, and wherein the width is at least twice the height.

10. The electrical connector of claim 9, wherein the aperture includes a first aperture between the wires, and the second locating feature is provided by a pin on the first housing portion that is covered by the second housing portion in an assembled connector condition.

11. The electrical connector of claim 10, wherein the aperture includes a second aperture between the wires, and the second locating feature is provided by a protrusion on the first housing portion that is outside of the second housing portion in an assembled connector condition.

12. The electrical connector of claim 9, wherein the aperture is a notch between the wires, and the second locating feature is a rib on the first housing portion arranged at an edge of the insulation at the stripped portion.

13. The electrical connector of claim 9, wherein the aperture is a notch arranged at an outer edge of the insulation, and the second locating feature is a locating pin on the first housing portion.

14. A method of assembling an electrical connector, comprising the steps of:

providing wiring with multiple wires, each wire having a conductor covered in insulation, the insulation includes webbing that interconnects the wires to one another, the insulation having an aperture providing a first locating feature, the wires having a stripped portion exposing the conductors, and wherein each of the conductors has a generally rectangular profile having a width and a height, wherein the width is at least twice the height;

mounting the stripped portion into a housing with a second locating feature, wherein the housing is provided by a first housing portion;

positioning the second locating feature into the aperture of the first locating feature; and securing a second housing portion to the first housing portion and about the stripped portion, wherein the second housing portion includes an electrical contact engaging the stripped portion during the securing step, wherein the mounting step includes retaining the stripped portion with first and second sets of barbs spaced apart from one another, the first and second sets of barbs retaining the stripped portion, and the insulation including edges adjacent to the first and second sets of barbs to longitudinally locate the wiring relative to the housing.

15. The method of claim 14, wherein the providing step includes forming the aperture in the insulation prior to the mounting and positioning steps.

* * * * *